United States Patent [19]

Short

[11] 4,261,498

[45] Apr. 14, 1981

[54] FABRIC ALIGNMENT METHOD AND MACHINE

[75] Inventor: Joe T. Short, West Point, Ga.

[73] Assignee: Milliken Research Corporation, Spartanburg, S.C.

[21] Appl. No.: 76,234

[22] Filed: Sep. 17, 1979

[51] Int. Cl.[3] ..... B65H 23/02

[52] U.S. Cl. ..... 226/3; 226/15

[58] Field of Search ..... 226/3, 15, 16; 101/248; 26/51.3–51.5; 68/178, 179; 200/87; 250/571, 572; 340/267 R, 267.1, 146.3

[56] References Cited

U.S. PATENT DOCUMENTS

| | | | |
|---|---|---|---|
| Re. 29,267 | 6/1977 | Leitner et al. | 26/51.5 |
| 2,077,439 | 4/1937 | Schmitt | 10/11 M |
| 2,840,659 | 6/1958 | Cooley | 200/87 |
| 3,313,942 | 4/1967 | Lange | 250/571 |
| 3,653,322 | 4/1972 | Richardson | 340/146.3 |
| 3,701,464 | 10/1972 | Crum | 226/3 |
| 3,750,129 | 7/1973 | Takeno et al. | 340/267 R |
| 3,830,084 | 8/1974 | Caputi | 68/178 |

*Primary Examiner*—Leonard D. Christian

*Attorney, Agent, or Firm*—Earle R. Marden; H. William Petry

[57] ABSTRACT

Method and apparatus to automatically detect and correct the bow and skew of a moving web of material. Individually controlled rolls are employed to speed up or retard the speed of a section of web material when a control mark is detected by a magnetic response detector to realign the section of fabric detected with other sections of the web of material.

16 Claims, 8 Drawing Figures

FABRIC ALIGNMENT METHOD AND MACHINE

It is an object of the invention to provide an apparatus which will automatically control the bow and skew of a continuous web of textile material as it passes through certain processes such as dyeing, finishing and/or back-coating.

Other objects and advantages of the invention will become readily apparent as the specification proceeds to describe the invention with reference to the accompanying drawings, in which.

Figure 1:
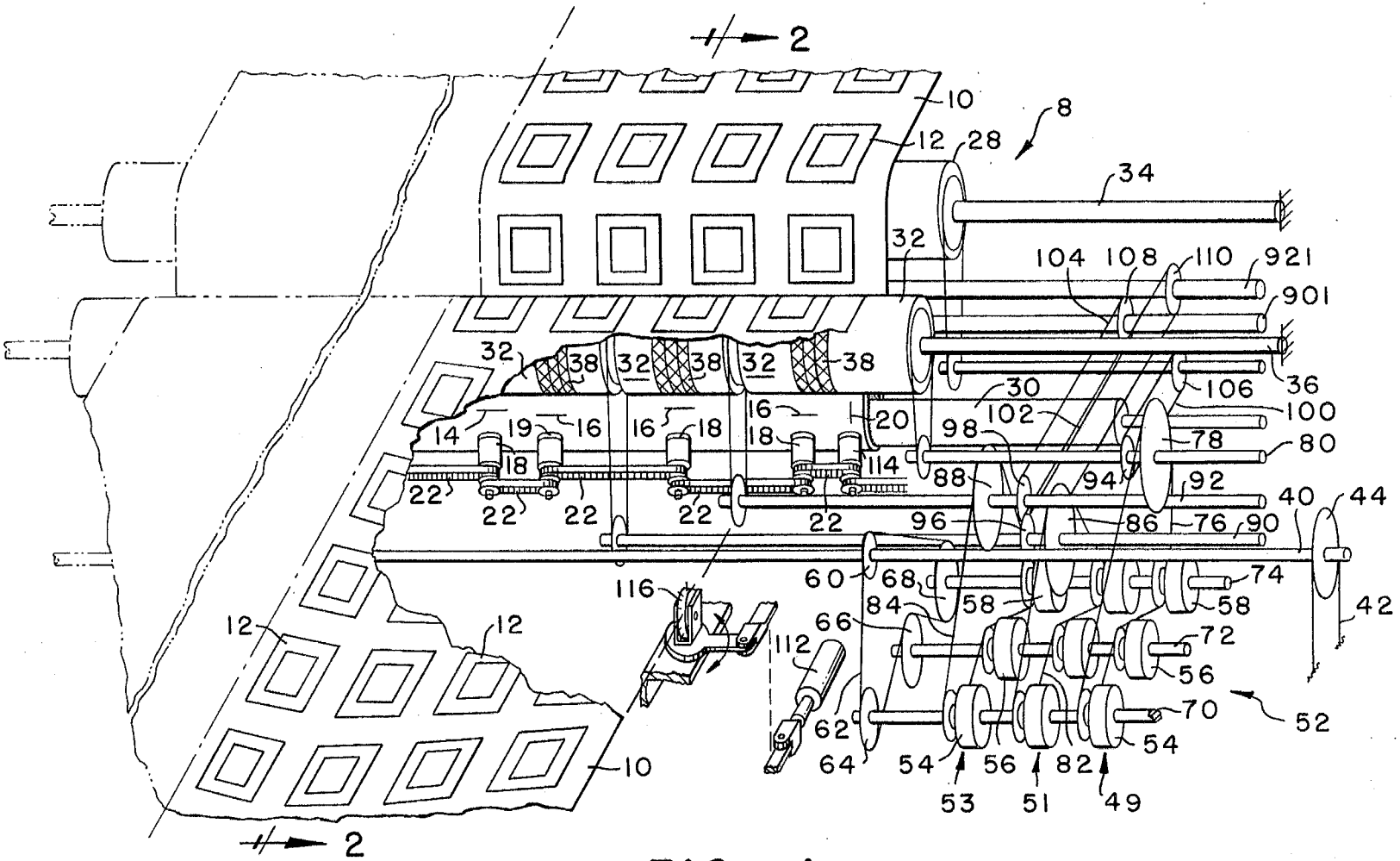
FIG. 1 is a schematic representation of the bow and skew control apparatus.

Looking now to the drawings and in particular to FIG. 1, schematically represented is the right hand half of a machine 8 to correct the bow and skew of an unfinished carpet 10 with a printed pattern 12 on the face thereof. For the purpose of detection and correction of the bow and skew of the carpet 10, a reference mark 14 and a plurality of detectable marks 16 are spaced across the back of the carpet 10. The marks 14 and 16 contain a ferrous material such as iron oxide or iron powder to provide a low reluctance path for the field of the magnetic sensors 18 and 19. An additional detector mark 20 is placed on both edges of the carpet for guiding and controlling the width thereof. In the preferred form of the invention, the marks 14 and 16 are approximately six inches in length with each set of marks being spaced longitudinally from the next adjacent set of marks, a distance of approximately two feet.

Figure 2:
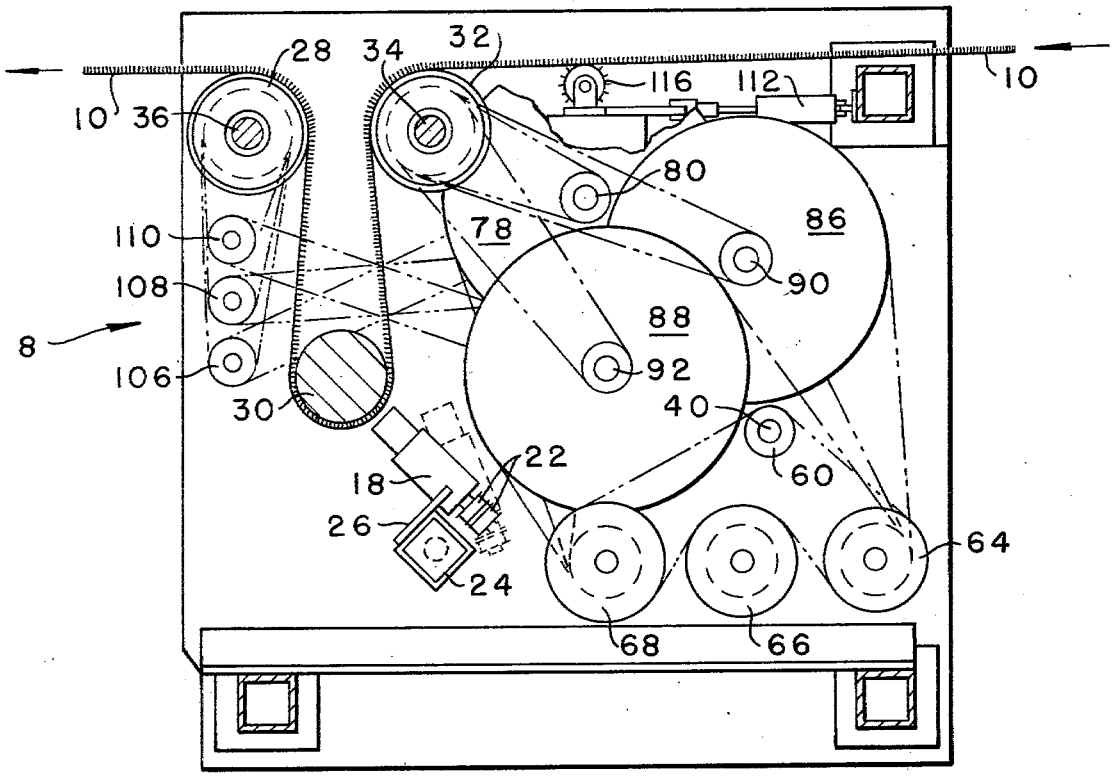
FIG. 2 is a section view on line 2–2 of FIG. 1.
Figure 3:
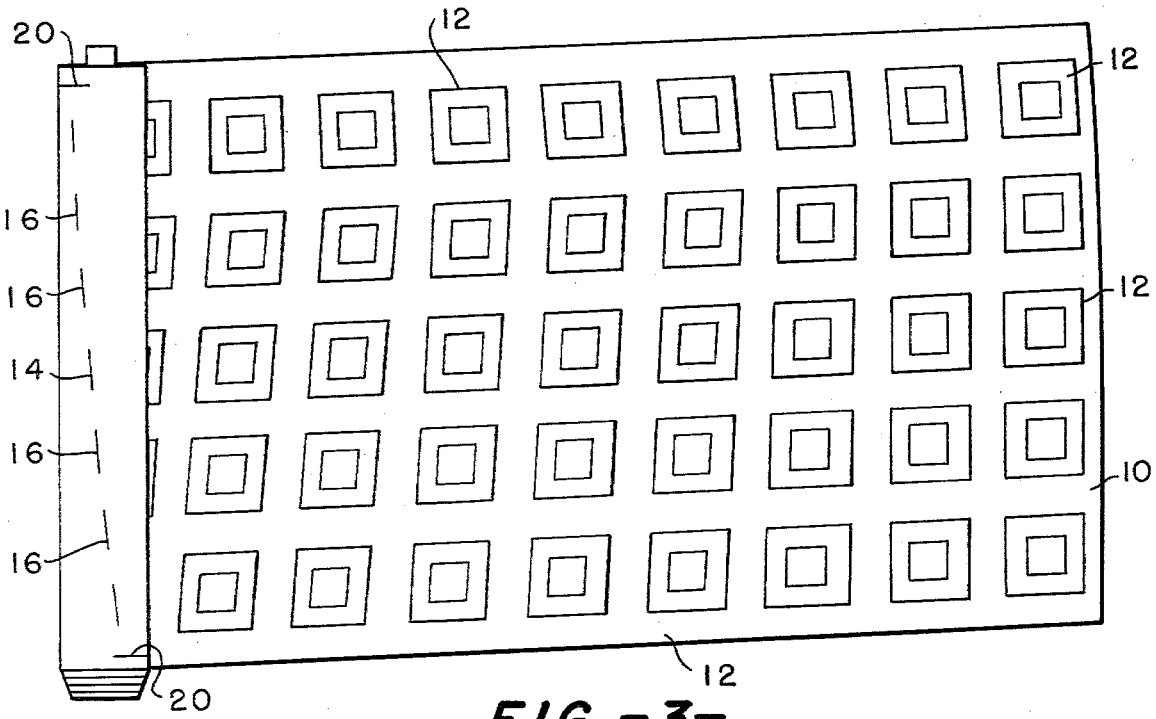
FIG. 3 represents a roll of unfinished fabric, such as carpet, with a bow and skew in the pattern.
Figure 4:
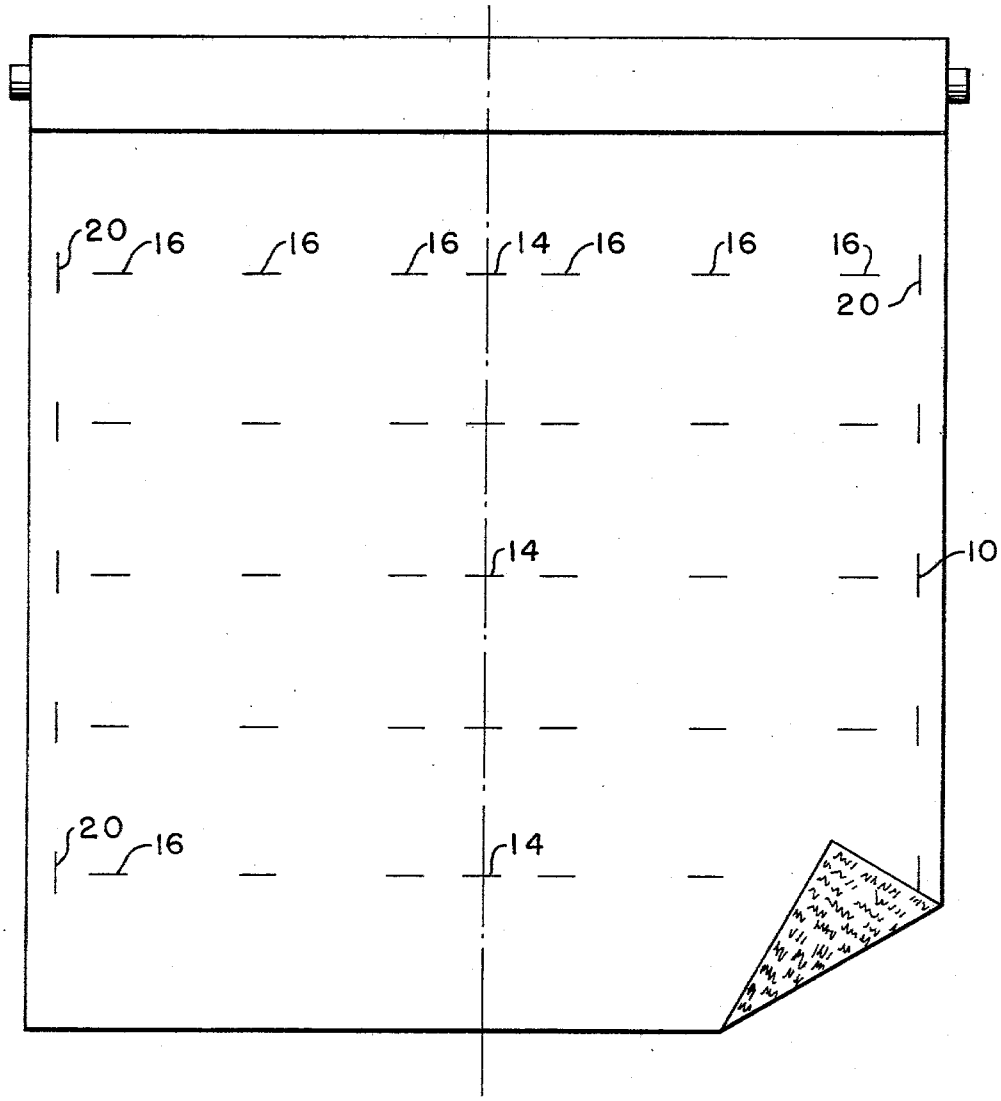
FIG. 4 represents the position of the registration lines on the back of a fabric to be controlled.

The magnetic sensors 18 and 19 are rotably mounted and driven by a series of timing belts 22 which in turn are driven by a drive motor (not shown). Looking at FIG. 2, each of the sensors 18 and 19 are connected to the rectangular frame member 24 by a suitable support 26. The rectangular frame 24 is mounted on journals and can be oscillated from the solid position to the dotted position to move the sensors out of the way of seams in the carpet 10.

The unfinished carpet 10 is supplied from a carpet machine such as a tufting machine (not shown) to the bow and skew machine 8 and then a further processing machine such as a back coater to coat the back of the carpet 10. The flow of the carpet 10 through the machine 8, as indicated by the arrows, is controlled by input segmented rolls 28, non-magnetic idler roll 30 and output segmented rolls 32. In the preferred embodiment of the invention there are six input rolls 28 and six output rolls 32. Each of the input rolls 28 are mounted for independent rotation on shaft 34 and each of the output rolls are mounted for independent rotation on shaft 36. Each segmented roll 28 and 32 has a center portion 38 that is covered with a suitable friction material to provide traction between the roll and the underside of the carpet 10.

A drive motor, not shown, drives the timing belts 24 for the magnetic sensors 18 and 19 and the main drive shaft 40 by means of a belt 42 and sheave 44. The main drive shaft 40 extends across the machine and drives the rolls on the right hand side of the machine as shown in FIG. 1 as well as an identical drive arrangement of the left side of the machine, not shown.

As indicated, each of the rolls 28 and 32 are driven by the belt 42 operably connected to the sprocket 44 fixed to the drive shaft 40. Each roll 28 and 32 is driven by a separate shaft from the clutch bank generally designated by the reference numeral 52. The clutch bank 52 consists of rows 49, 51 and 53 each having a high speed electric clutch 54, a standard speed electric clutch 56 and a low speed electric clutch 58 for each set of rolls 28 and 32 operably associated with the clutch bank.

The clutches 54, 56 and 58 are driven off the main drive shaft 40 from a sprocket 60 and a chain 62 which drives the sprockets 64, 66 and 68 connected respectively to the low speed clutch shaft 70, the standard speed clutch shaft 72 and the high speed clutch shaft 74. The clutches of row 49 are connected by a chain 76 to a sprocket 78 which through countershaft 80 drives the first roll 32. In the same manner clutches 51 and 53 are connected by chains 82 and 84, respectively to sprockets 86 and to drive the third roll 32 and the center roll 32 through shafts 90 and 92. Each of the shafts 80, 90 and 92 have sprockets 94, 96 and 98, respectively fixed thereto to drive the corresponding input roll 28 at the same speed through chains 110, 102 and 104 which through sprockets 106, 108 and 110 drive shafts 34, 901 and 921.

The width control mark 20 on each side of the carpet 10 controls the operation of the piston 120 in response to its detection by the magnetic sensor 114. Depending on the position of the mark 20 the pin wheel 116 will be rotated one way or the other by the piston 112 to control the width of the carpet 10.

Figure 5:
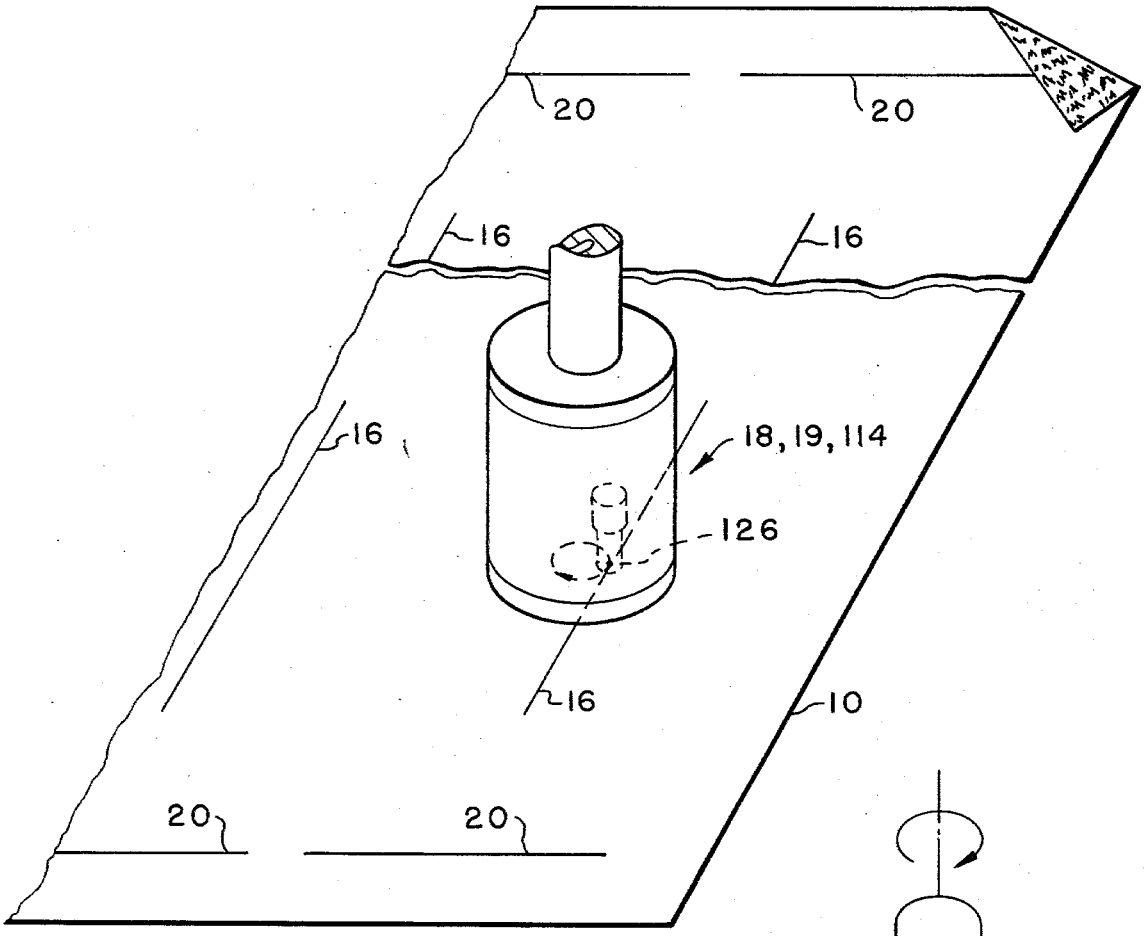
FIG. 5 illustrates the operation of a magnetic sensor sensing a registration line on the back of a fabric.
Figure 6:
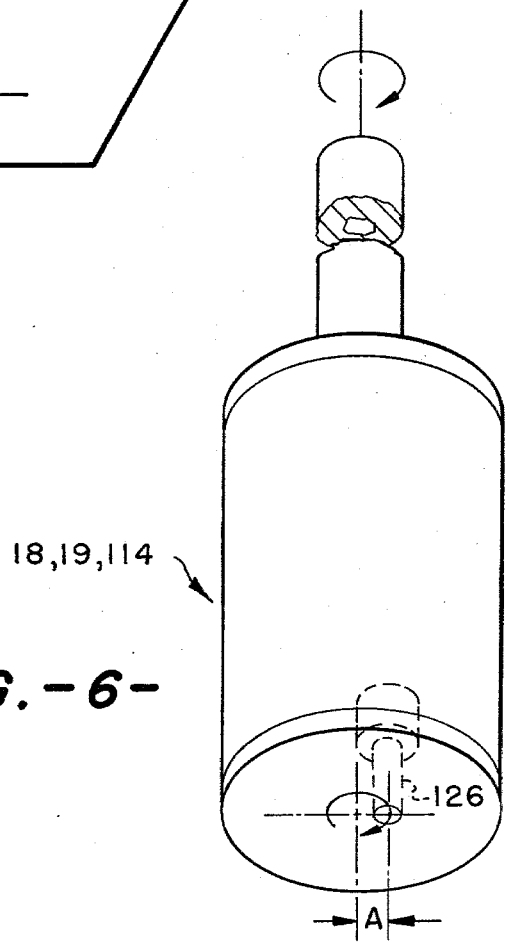
FIG. 6 is a blown-up view of the sensor shown in FIG. 5.
Figure 7:
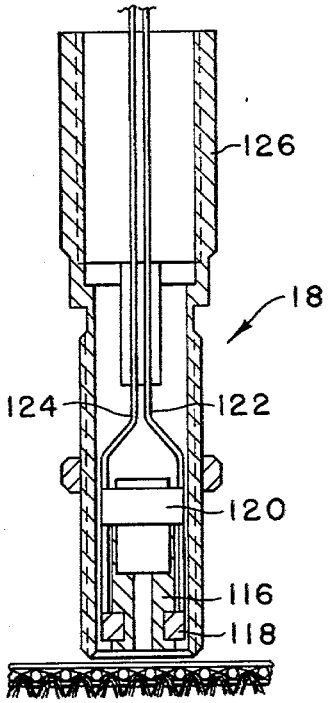
FIG. 7 is a cross-section view of the magnetic sensor in position relative to the fabric being sensed.

Looking now to FIGS. 5–7 the particular magnetic sensor 18, 19 or 114 is illustrated. The sensor basically consists of a pole piece 116, a coil 118, a permanent magnet 120, two signal wires 122 and 124 and a housing 126, all of which are enclosed in another housing or cylindrical tube generally denoted as the sensor 18, 19 or 114. A magnetic field extends from the magnetic 120 through the pole-piece 116 and out into the air space at the end of the pole piece. The return path of the field is from the air space to the other end of the magnet 120. As a ferrous object approaches the tip of the pole-piece 116, the magnetic field contracts. As the ferrous object passes away from the tip of the pole-piece, the magnetic field expands. When the magnetic field contracts, it induces a voltage in the coil 118 in one direction and when it expands, it induces a voltage in the coil in the opposite direction. The passage of one ferrous object induces one pulse. The magnitude of the voltage induced is proportional to the rate at which a ferrous object approaches or moves away from the tip of the pole-piece.

In the present application of this sensor, the registration lines can be sensed as long as the fabric is moving at or near its maximum rate of travel; however, the registration lines can not be sensed when the fabric is moving slowly because the magnitude of the induced voltage is too small. In order to overcome this problem the sensor is mounted in the end of the cylindrical tube 18, 19 or 114 which is rotated. Note from FIG. 6 that the center line of the pole piece is located a distance "A" from the center of rotation of the cylinder which in the preferred form of the invention is 25 inches. This arrangement means that the pole piece is moving in a circular path the diameter of which is 0.5 inches. Observe in FIG. 5 that the pole piece passes across the registration line twice for each complete rotation of the cylinder, except when the registration line is tangential to the circular path of the pole piece where a single, but longer intersection of the path of the pole piece with the registration line occurs. With this arrangement the rate of rotation of the cylinder can be adjusted to accommodate registration lines with varying amounts of ferrous material.

OPERATION

Figure 8:
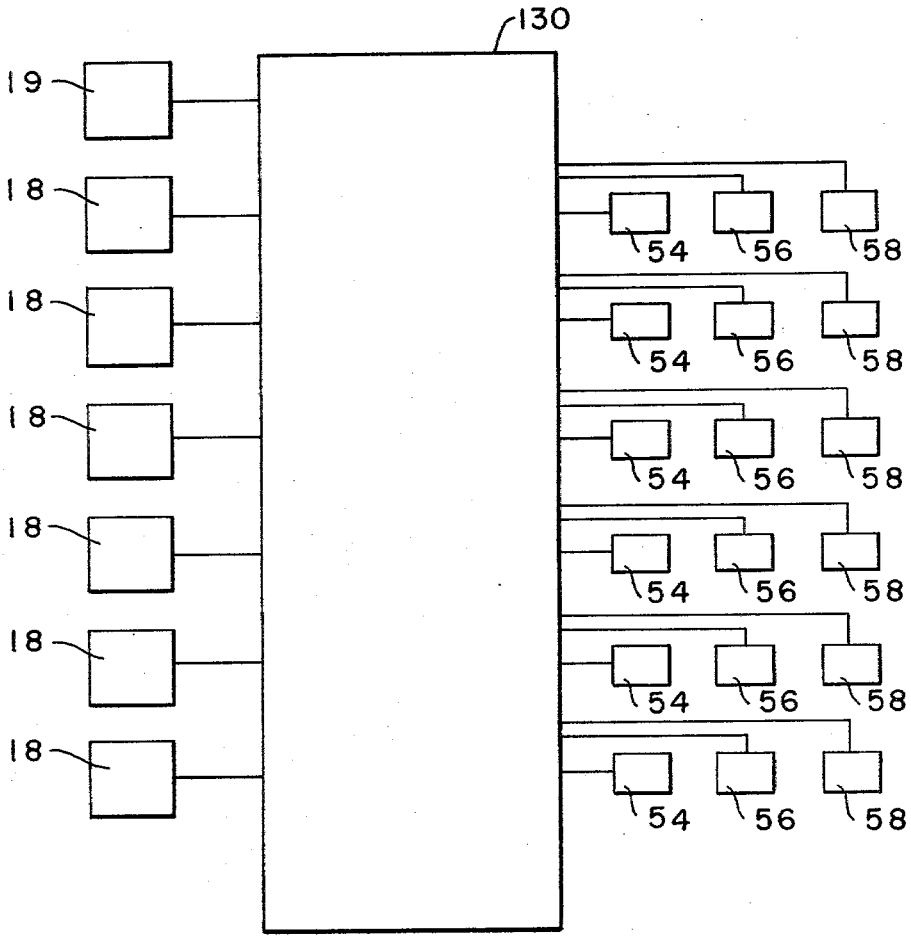
FIG. 8 is a schematic representation of the operation of the control system.

In operation, the web of material or carpet 10, which has previously had marking 14, 16 and 20 applied to the back thereof in register with the pattern 12 on the face, is fed through a dyeing and drying process. Then, prior to back coating to provide a backing material thereto, the carpet 10 is supplied to the input rolls 28 of the machine 8. The carpet 10 then passes under the idler roll 30 to the output rolls 32. As the carpet 10 is delivered to the segmented output rolls 32, the markings 14 and 16, as well as the markings 20, are sensed by the rotating magnetic sensors 18, 19 and 114. The pulses generated by the sensors 18 and 19 are supplied to the electronic comparator 130 (FIG. 8) where each of the pulses from the sensors 18 are compared to the reference pulse from the sensor 19 to determine whether the segment of the carpet sensed is traveling slower or faster than the reference segment. Then, depending on the result of the comparison, one of the clutches 54, 56 or 58 for the roll segment during that portion of the carpet, is energized to either speed up, maintain or slow down that segment of the carpet. The particular clutch energized controls the speed of both the corresponding input and output rolls simultaneously. Since the rows of markings are spaced a predetermined distance from each other, the markings are continuously scanned to maintain the marks in a line to maintain the pattern in registration. In like manner, the mark 20 is scanned by the sensor 114 to control the width of the carpet 10 by actuation of the piston 120 to correctly position the pin wheel 116.

It is obvious that a machine has been described which will automatically and continuously maintain a traveling web of material in the position desired as determined by the sensing marks placed on the back thereof.

Although I have described specifically the preferred embodiment of my invention, I contemplate that changes may be made without departing from the scope or spirit of the invention and I desire to be limited only by the scope of the claims.

I claim:

1. Apparatus to correct the alignment of a web of material having a plurality of rows of ferrous containing markings on the back thereof comprising: a frame, a plurality of input rolls, a plurality of output rolls, each of the input rolls having a corresponding output roll, means to drive the corresponding input roll and output roll in synchronism, means to supply the web of material to said input and output rolls, means to drive each set of corresponding input and output rolls separate from the drive of the other sets of corresponding input and output rolls, means to vary the speed of each set of corresponding input and output rolls and means operably associated with the ferrous markings on the back of the web material to sense the position of the markings to control the means to vary the speed of each set of corresponding input and output rolls.

2. The apparatus of claim 1 wherein said means to sense is located between said input and output rolls.

3. The apparatus of claim 1 wherein said means to sense is a magnetic sensor.

4. The apparatus of claim 3 wherein said magnetic sensor is rotably mounted to said apparatus.

5. The apparatus of claim 1 wherein said means to vary the speed of the input and output rolls includes a series of clutches.

6. The apparatus of claim 5 wherein said series of clutches are electrically actuated.

7. The apparatus of claim 6 wherein said series of clutches includes a high speed clutch, a standard speed clutch and a low speed clutch.

8. The apparatus of claim 7 wherein said means to sense is located between said input and output rolls.

9. The apparatus of claim 8 wherein said means to sense is a magnetic sensor.

10. The apparatus of claim 9 wherein said magnetic sensor is rotably mounted to said apparatus.

11. The apparatus of claim 10, wherein a means is provided to control the width of the web of material.

12. The apparatus of claim 11 wherein the means to control the width of the web of material is a rotably mounted pin wheel on both sides of the apparatus adapted to engage the selvedge of the web of material.

13. The apparatus of claim 1 wherein a means is provided to control the width of the web of material.

14. The apparatus of claim 13 wherein the means to control the width of the web of material is a rotably mounted pin wheel on both sides of the apparatus adapted to engage the selvedge of the web of material.

15. A method of maintaining the alignment of the pattern on a web of material comprising: placing a plurality of rows of ferrous marks on the back of the web of material in registry with the pattern on the other side of the web of material passing the web of material over a plurality of aligned rolls, sensing each line of ferrous marks as they pass a reference point and generating a pulse, and supplying the generated pulse to one of the aligned rolls to control the speed thereof.

16. The method of claim 15 wherein each row of ferrous marks includes a reference mark and each of the reference marks is compared to the pulse generated by the sensed pulse.

* * * * *

UNITED STATES PATENT OFFICE

CERTIFICATE OF CORRECTION

Patent No. 4,261,498 Dated April 14, 1981

Inventor(s) Joe T. Short

It is certified that error appears in the above-identified patent and that said Letters Patent are hereby corrected as shown below:

Column 2, line 32, the numeral "110" should be --100--.

Column 2, line 47, "magnetic" second occurrence, should be --magnet--.

Signed and Sealed this

*Eighth* Day of *September 1981*

[SEAL]

*Attest:*

GERALD J. MOSSINGHOFF

*Attesting Officer* *Commissioner of Patents and Trademarks*